US011490683B2

(12) United States Patent
Hillyer et al.

(10) Patent No.: US 11,490,683 B2
(45) Date of Patent: Nov. 8, 2022

(54) FOOTWEAR INCLUDING A STABILIZING SOLE

(71) Applicant: DECKERS OUTDOOR CORPORATION, Goleta, CA (US)

(72) Inventors: Christopher Hillyer, Goleta, CA (US); Zack Paris, Goleta, CA (US); Kyle Pulli, La Jolla, CA (US)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 168 days.

(21) Appl. No.: 16/790,422

(22) Filed: Feb. 13, 2020

(65) Prior Publication Data

US 2020/0178646 A1 Jun. 11, 2020

Related U.S. Application Data

(63) Continuation of application No. 15/350,747, filed on Nov. 14, 2016, now Pat. No. 10,561,199.

(51) Int. Cl.

| | |
|---|---|
| ***A43B 13/18*** | (2006.01) |
| ***A43B 13/12*** | (2006.01) |
| ***A43B 13/22*** | (2006.01) |

(52) U.S. Cl.

CPC ..... *A43B 13/186* (2013.01); *A43B 13/125* (2013.01); *A43B 13/188* (2013.01); *A43B 13/223* (2013.01)

(58) Field of Classification Search

CPC ... A43B 13/181; A43B 13/141; A43B 13/184; A43B 13/223; A43B 13/26; A43B 5/002; A43B 5/06

USPC ..... 36/30 R

See application file for complete search history.

(56) References Cited

U.S. PATENT DOCUMENTS

| | | | | |
|---|---|---|---|---|
| 7,200,955 | B2 * | 4/2007 | Foxen | A43B 13/189 36/25 R |
| 8,272,149 | B2 * | 9/2012 | Cooper | A43B 13/141 36/102 |
| 8,595,956 | B2 | 12/2013 | Byrne | |
| 2003/0192202 | A1 | 10/2003 | Schoenborn et al. | |
| 2005/0268490 | A1 * | 12/2005 | Foxen | A43B 13/189 36/28 |
| 2005/0268492 | A1 | 12/2005 | Fuerst | |
| 2007/0277401 | A1 * | 12/2007 | Young-Chul | A43B 13/186 36/30 R |
| 2011/0185590 | A1 | 8/2011 | Nishiwaki et al. | |
| 2011/0192056 | A1 | 8/2011 | Geser et al. | |
| 2012/0317845 | A1 | 12/2012 | Vattes | |
| 2013/0081305 | A1 | 4/2013 | Byrne | |
| 2014/0123522 | A1 | 5/2014 | Rustam et al. | |
| 2014/0259784 | A1 | 9/2014 | Jenkins et al. | |

(Continued)

*Primary Examiner* — Timothy K Trieu

(74) *Attorney, Agent, or Firm* — Greer, Burns & Crain, Ltd.

(57) ABSTRACT

An article of footwear is provided and includes an upper having a width and a footbed. A sole is attached to the upper and includes a heel portion, a lateral side and a medial side. The sole includes an upper surface and a lower surface, where the upper surface extends across the width of the upper, and where the footbed is on the upper surface of the sole. The sole forms a shell having a sidewall that extends from the lateral side around the heel portion to the medial side, where the sidewall extends along the upper to a point above a top surface of the footbed.

18 Claims, 7 Drawing Sheets

(56) References Cited

U.S. PATENT DOCUMENTS

| | | | | |
|---|---|---|---|---|
| 2014/0325876 | A1* | 11/2014 | Dodge | A43B 7/1445 36/103 |
| 2014/0373392 | A1 | 12/2014 | Cullen | |
| 2015/0181976 | A1 | 7/2015 | Cooper et al. | |

* cited by examiner

FOOTWEAR INCLUDING A STABILIZING SOLE

BACKGROUND

The present application relates generally to footwear, and more particularly, to a stabilizing sole for footwear that uniformly supports a wearer's feet to help absorb the stress and shock on a person's body generated during repeated impact between their feet and the ground during impact movements such as walking, jogging and running.

Running is particularly hard on a person's feet and body. For example, the impact of each foot striking the ground during running is the equivalent of three to five times of your body weight or more. Insufficient cushioning and support and/or misalignment of a person's feet within their shoes reduces the absorption of this impact, thereby transferring more of the shock and stress to the user's body, and unnecessarily stressing the knees, hips and lower back. As a person runs, the shock and stress is repeated at every impact or foot strike with the ground, which can cause stress injuries, pain and excess wear on the person's joints.

When the feet and ankles are properly supported and aligned, a person's body is able to absorb large impact forces. Also, overall stability and biomechanical efficiency improves to help the feet absorb and reduce impact forces, while forming an efficient lever to channel power correctly during propulsion. Footwear manufacturers utilize these concepts when developing and improving footwear alignment and support structures for shoes.

There are many different types of support structures for footwear to help absorb the shock and stresses on a user's feet. These structures typically revolve around the midsoles and outsoles but may also include the uppers. Some of the structures involve changing the thicknesses of the midsole and/or outsole to provide more cushioning and support to different parts of a user's foot. For example, the combined thickness of the midsole and outsole may be greater at a certain portion of a user's foot, such as the heel, to provide more support for the heel during walking, jogging or running. Alternatively, the combined thickness of the midsole and outsole may be greater at the medial or lateral sides of a shoe to help compensate for the roll of a person's foot during running such as over pronation or under pronation, i.e., supination.

Other support structures utilize different materials to form the midsole and outsole, where the materials have different hardness levels. For example, the hardness of the material used to form the midsole may be greater than the hardness of the outsole such that the outsole absorbs most of the impact and the harder midsole provides support for the feet. Similarly, the hardness of the materials may be different at different portions of the foot to cushion and support the different portions of the foot. Some shoes include a harder material on the inner or medial side of a shoe to form a medial post that helps reduce the rolling of a person's foot to the medial side.

Therefore, it is desirable to provide footwear that uniformly supports and aligns a person's feet during walking, jogging and running to help reduce the stresses on a person's feet and body.

SUMMARY

The present article of footwear includes a sole having a midsole and an outsole where the midsole and outsole combine to form a shell having a sidewall that extends above a footbed in the upper to cradle and align a wearer's foot in the article of footwear during use. The sole also provides stability and alignment to the foot by providing enhanced support on the medial a lateral sides of the foot.

In an embodiment, an article of footwear is provided and includes an upper having a width and a footbed. A sole is attached to the upper and includes a heel portion, a lateral side and a medial side. The sole includes an upper surface and a lower surface, where the upper surface extends across the width of the upper, and where the footbed is on the upper surface of the sole. The sole forms a shell having a sidewall that extends from the lateral side around the heel portion to the medial side, where the sidewall extends along the upper to a point above a top surface of the footbed.

In another embodiment, an article of footwear is provided and includes an upper having a width and including a footbed. The sole is attached to the upper and includes a heel portion, a lateral side and a medial side, where the sole includes an upper surface and a lower surface. The upper surface extends across the width of the upper, where the footbed is on the upper surface of the sole. The sole forms a shell having a sidewall, where the sidewall extends along the upper to a point above a top surface of the footbed. The sole also includes a first portion having a first hardness and a second portion having a second hardness, where the first hardness is different from the second hardness, and where the first portion extends along the lateral side about the heel portion and along at least part of the medial side.

DETAILED DESCRIPTION

The present sole is attached to an upper to form an article of footwear that stabilizes and cushions a wearer's foot during walking, jogging and running. More specifically, the present sole includes a midsole and an outsole where the outsole is made of a material having a greater hardness than the hardness of the midsole and extends from the lateral side, around the heel to the medial side of the foot on the article of footwear to provide stability and cushioning for the foot and support of the medial side of the foot.

Figure 4:
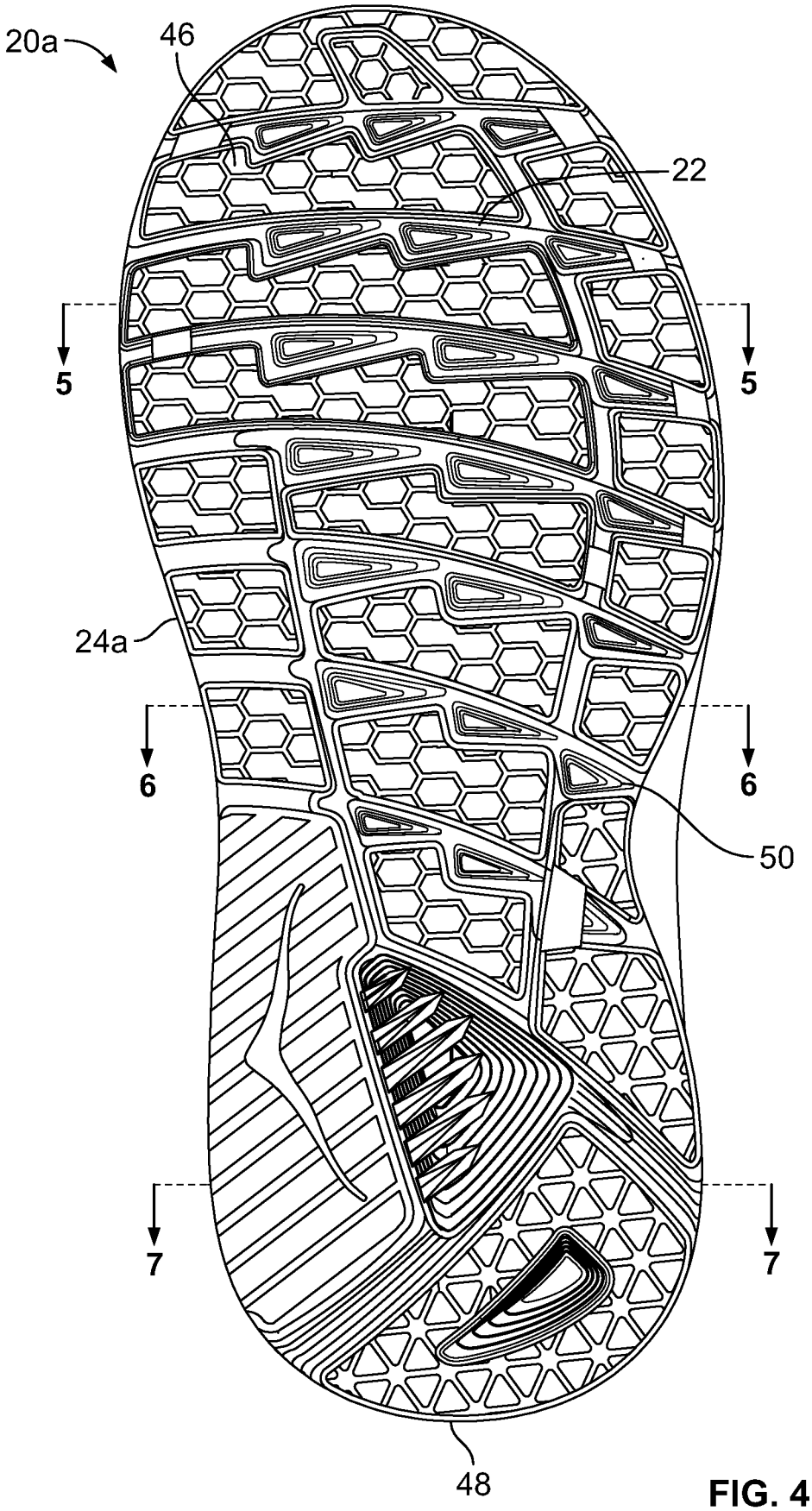
FIG. 4 is a bottom view of the article of footwear of FIG. 2.
Figure 5:
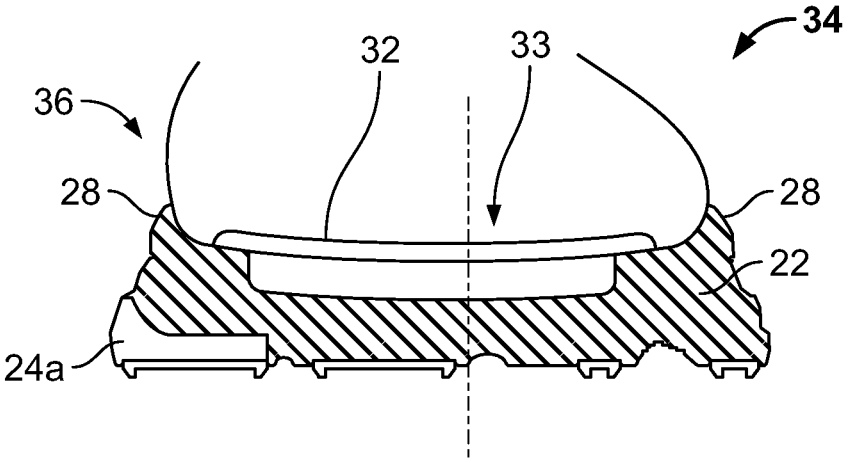
FIG. 5 is a fragmentary, cross-section view of the article of footwear of FIG. 2 taken substantially along the line 5-5 shown in FIG. 4 in the direction generally indicated.
Figure 6:
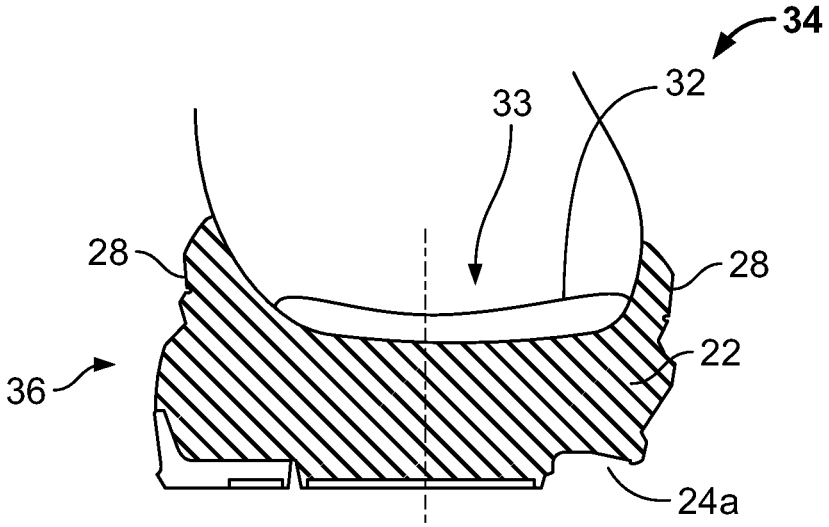
FIG. 6 is a fragmentary, cross-section view of the article of footwear of FIG. 2 taken substantially along the line 6-6 shown in FIG. 4 in the direction generally indicated.
Figure 7:
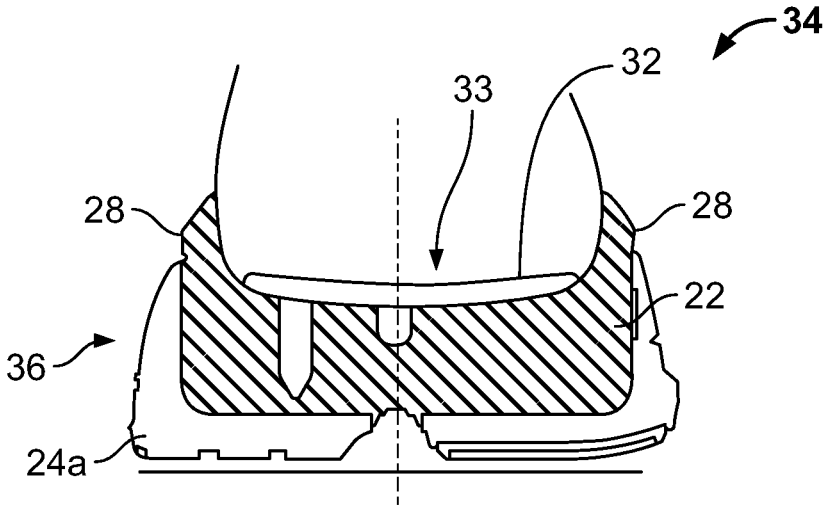
FIG. 7 is a fragmentary, cross-section view of the article of footwear of FIG. 2 taken substantially along the line 7-7 shown in FIG. 4 in the direction generally indicated.
Figure 8:
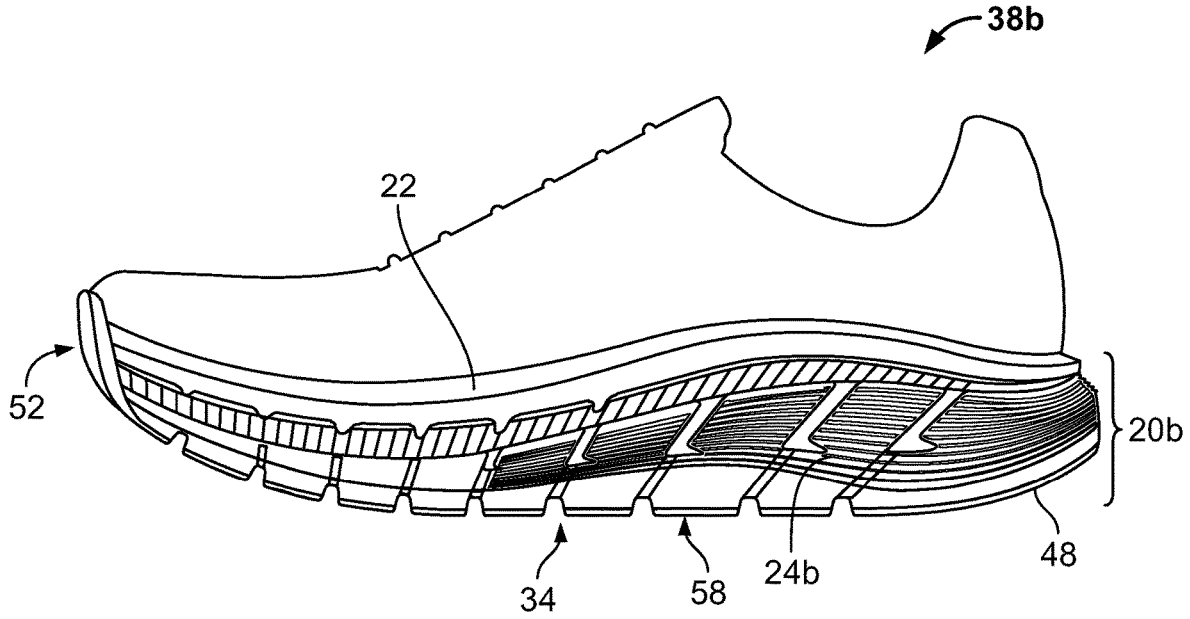
FIG. 8 is an elevational view of the medial side of an article of footwear including another embodiment of the present sole.
Figure 9:
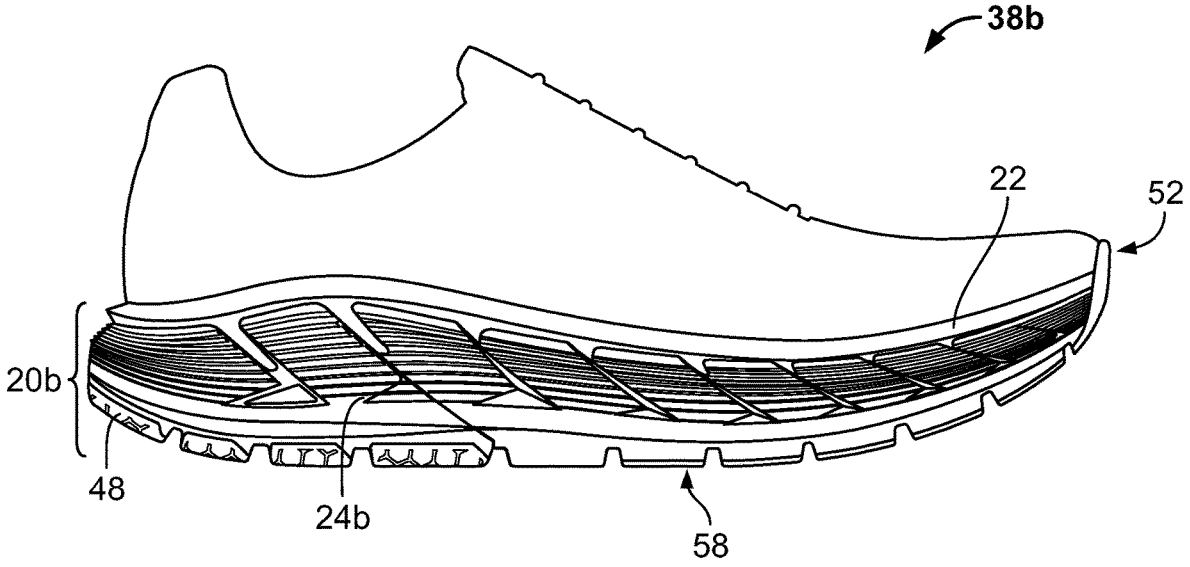
FIG. 9 is an elevational view of the lateral side of the article of footwear of FIG. 8.
Figure 10:
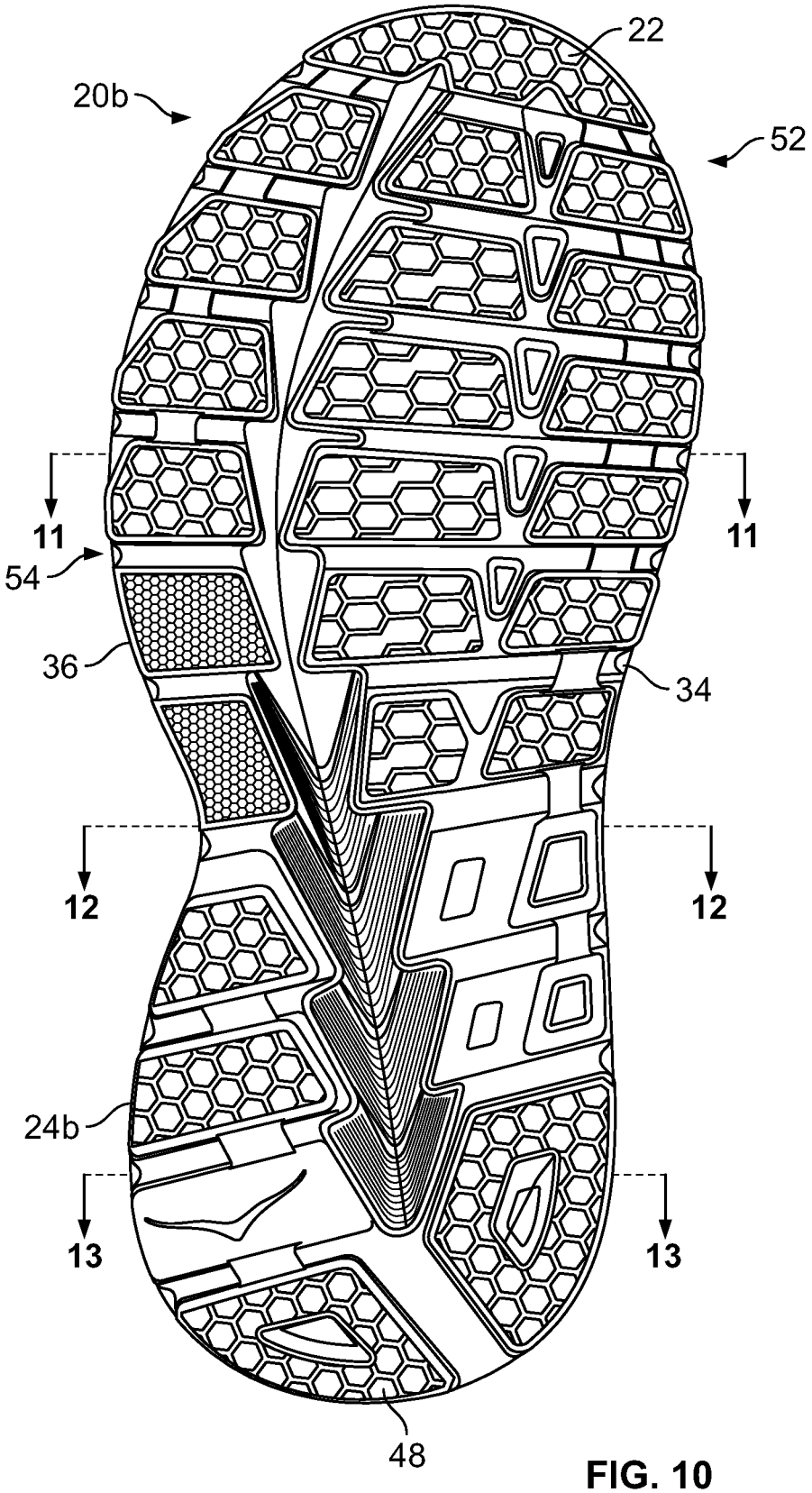
FIG. 10 is a bottom view of the article of footwear of FIG. 8.

Referring now to FIGS. 1-7, an embodiment of the present sole, generally indicated as 20*a*, includes a midsole 22 and an outsole 24*a*. The midsole 22 forms an integral shell including a bottom surface 26, a sidewall 28 that extends about the entire periphery of the midsole, and a top surface 30. As shown in FIG. 5-7, the sidewall 28 extends away from the top surface 32 of the footbed 33 on the medial side 34 and the lateral side 36 of the article of footwear 38*a* such that the sidewall 28 is above the top surface 32 of the footbed on at least the medial and lateral sides of the article of footwear 38 when the article of footwear 38*a* is positioned on an underlying surface. In another embodiment, the sidewall 28 extends above the top surface 32 of the footbed 33 about the entire periphery of the sole 20*a*. In the illustrated embodiment, the sidewall 28 extends seventy percent (70%) of the height of the combined sidewall or total sidewall 40 of the article of footwear where the height is measured from the ground or underlying surface to topmost surface 42 of the total sidewall. The midsole 22 therefore provides rigid support on both the medial and lateral sides of a foot to cradle the foot and limit the movement of the foot toward the medial and lateral sides of the article of footwear 38. Such support also helps to keep the foot aligned in the article of footwear 38*a* to reduce shock and stress on the foot and help channel the motion of the foot primarily to forward and backward motions to improve energy efficiency.

Figure 1:
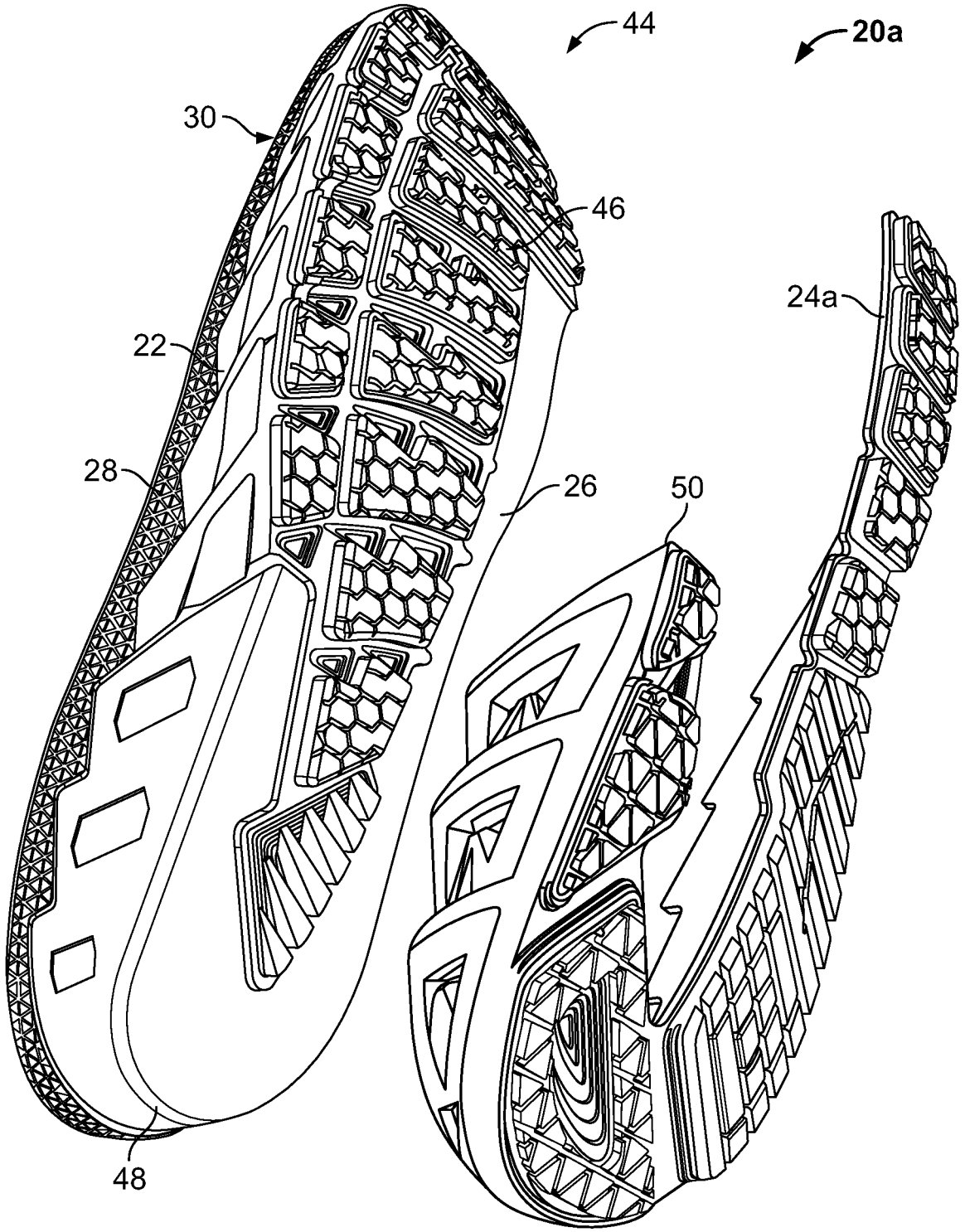
FIG. 1 is an exploded perspective view of the present sole.
Figure 2:
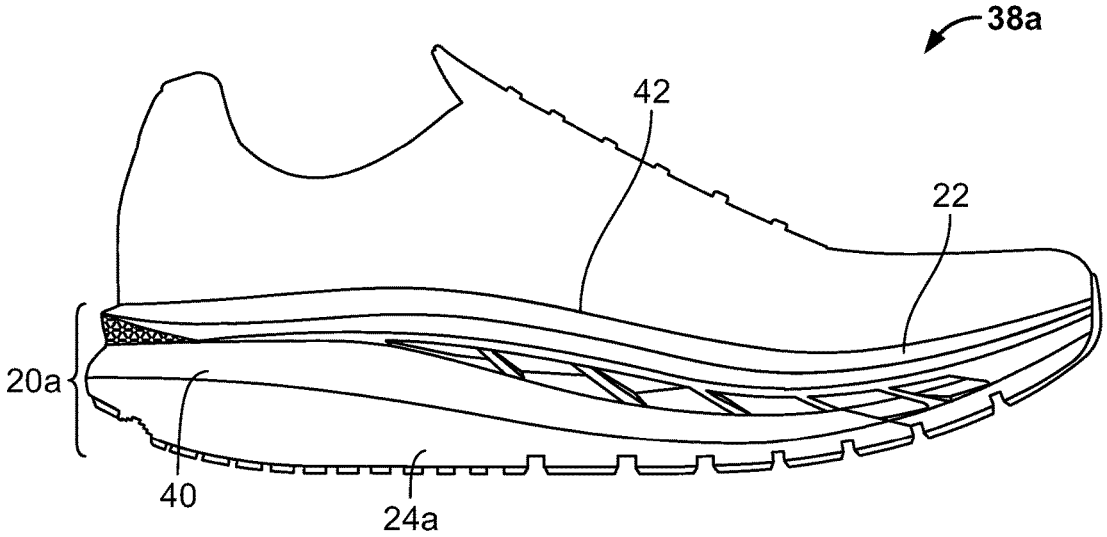
FIG. 2 is an elevational view of the medial side of an article of footwear including the sole of FIG. 1.
Figure 3:
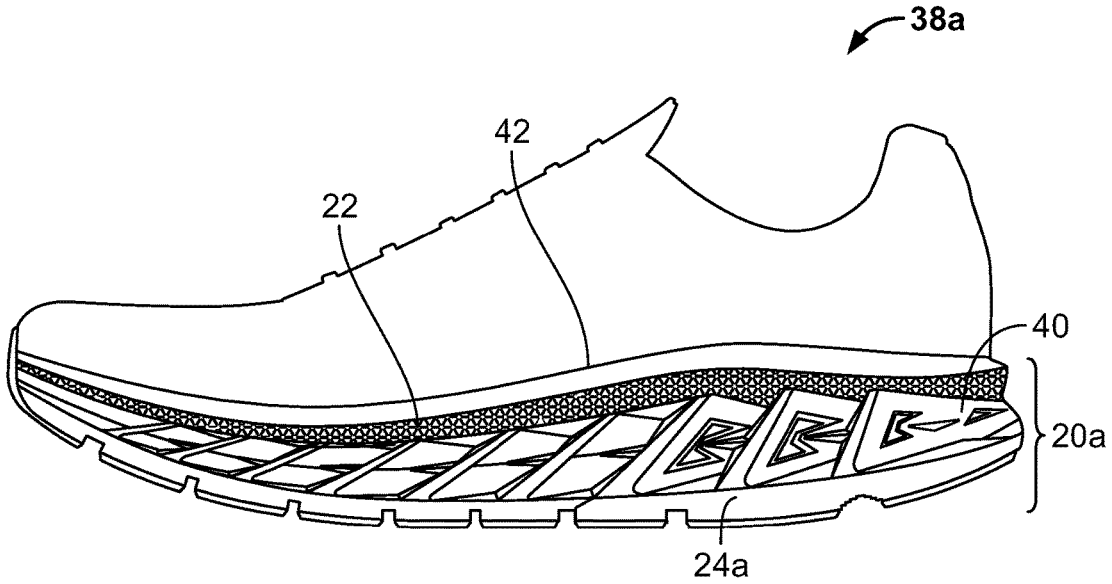
FIG. 3 is an elevational view of the lateral side of the article of footwear of FIG. 1.

As shown FIG. 1 of the illustrated embodiment, a ground-contacting portion 44 of the midsole 22 contacts the ground and thereby includes tread 46 to help grip the ground or other underlying surface during use. The tread 46 may have the same hardness and density as the midsole 22 or have a different hardness and density depending on the terrain that the article of footwear 38*a* will be used on. In an embodiment, the tread 46 is made of rubber. It should be appreciated that the tread 46 may be have any suitable pattern and be made of any suitable material or combination of materials.

The outsole 24*a* is attached to the midsole 22 and is made of a material that has a density and hardness that is greater than the density and hardness of the midsole. For example, in the illustrated embodiment, the outsole 24*a* has a hardness of 55 Asker and the midsole 22 has a hardness of 45 Asker. As such, the outsole 24*a* provides stability to the sole 20*a*, and the midsole 22 provides cushioning and additional stability for a wearer's foot. The hardness of the midsole 22 and the outsole 24*a* may be any suitable hardness values where the difference in the hardness for the midsole and outsole is at least 10 Asker. Also, the outsole 24*a* is preferably made of Ethylene Vinyl Acetate (EVA). Alternatively, the outsole 24*a* may be made of a mixture or blend of EVA and rubber, but may also be made of any suitable material or combination of materials. The midsole 22 is also made of EVA but may be made with foam compounds having designated densities, rebound characteristics and material compositions or other suitable materials or combinations of materials.

As shown in FIGS. 1 and 4, the outsole 24*a* extends from the lateral side 36 around the heel 48 to a position 50 adjacent to the metatarsal bone, and more specifically, the metatarsal head in a wearer's foot on the medial side 34 of the sole 20*a*. In this way, the outsole 24*a* provides a rigid, stable cup or cradle for the heel of the foot during use and also provides sufficient support to the medial side of the foot to help inhibit rolling of the foot such as over pronation. Furthermore, the proportion of the denser, harder outsole material to the softer midsole material provides enhanced cushioning and stability to the foot.

Figure 11:
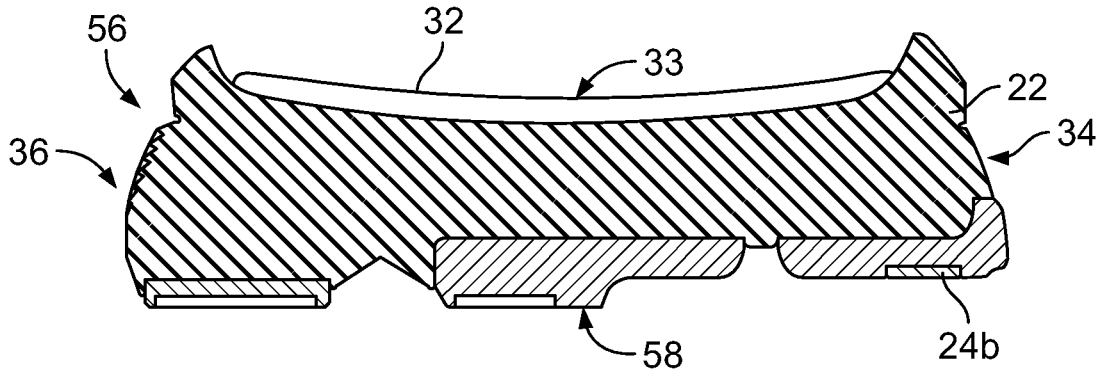
FIG. 11 is a fragmentary, cross-section view of the article of footwear of FIG. 8 taken substantially along the line 11-11 shown in FIG. 10 in the direction generally indicated.
Figure 12:
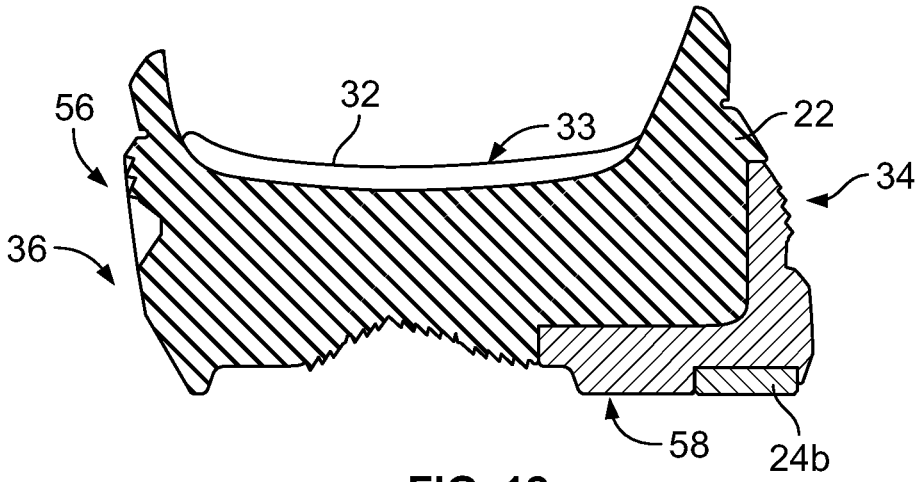
FIG. 12 is a fragmentary, cross-section view of the article of footwear of FIG. 8 taken substantially along the line 12-12 shown in FIG. 10 in the direction generally indicated.
Figure 13:
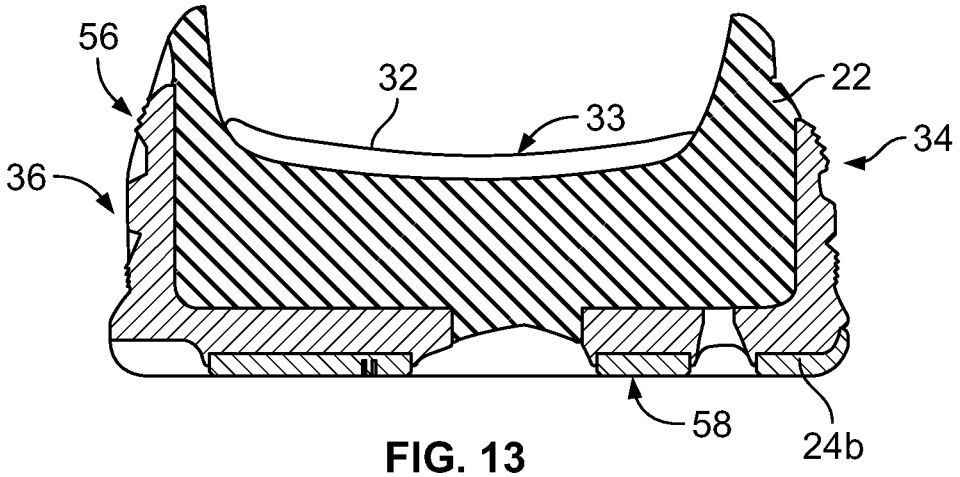
FIG. 13 is a fragmentary, cross-section view of the article of footwear of FIG. 8 taken substantially along the line 13-13 shown in FIG. 10 in the direction generally indicated.

Referring to FIGS. 8-13, in another embodiment, the outsole 24*b* extends from the lateral side of the sole 20*b*, around the heel 48 and along the entire medial side 34 of the sole. In this embodiment, the outsole 24*b* continues around the toe or front portion 52 of the sole 20*b* and to a point or position 54 on the lateral side 36 of the shoe. This sole construction provides added support and stability to a wearer's foot during use. Further, the midsole 22 and outsole 24*b* forming the sole are made of the same materials and have the same hardness and density value as described above. As shown in FIGS. 11-13, the combined sidewall 56 of the midsole 22 and the outsole 24*b* extends above the top surface 32 of the footbed 33 to cradle the foot on both the medial and lateral sides of the article of footwear. This sole configuration helps to limit movement of the foot in the article of footwear as well as provides stability and rigidity for limiting rolling of the foot during use.

In the above embodiments, the medial sidewall of the midsole 22 and outsole 24*a*, 24*b* has a first height relative to the bottom surface 58 of the article of footwear 38*a*, 38*b* and the lateral sidewall of the midsole 22 and outsole 24*a*, 24*b* has a second height relative to the bottom surface of the article of footwear. In an embodiment, the height of the medial sidewall is greater than the height of the lateral sidewall such that the sidewalls of the medial and lateral sidewalls are asymmetrical relative to a longitudinal axis extending through the article of footwear. This construction provides more support to the medial side of the article of footwear to help control inward rolling of the foot during use. In another embodiment, the heights of the medial and lateral sidewalls of the midsole 22 and outsole 24*a*, 24*b* are symmetrical relative to each other, i.e., the heights of the medial and lateral sidewalls are the same. This construction provides equal support to a foot (neutral stability) on the medial and lateral sides 34, 36 of the article of footwear 38*a*, 38*b*. In a further embodiment, the height of the lateral sidewall relative to the bottom surface 58 of the article of footwear 38*a*, 38*b* is greater than the height of the medial sidewall relative to the bottom surface 58 of the article of footwear 38*a*, 38*b*. This construction provides greater support to the lateral side of the foot during use to help control outward rolling of the foot. It should be appreciated that the heights of the medial and lateral sidewalls of the article of footwear may be any suitable heights relative to the bottom surface of the article of footwear 38*a*, 38*b*.

While particular embodiments of the present sole for an article of footwear have been shown and described, it will be appreciated by those skilled in the art that changes and modifications may be made thereto without departing from the invention in its broader aspects and as set forth in the following claims.

What is claimed is:

1. An article of footwear comprising:

an upper having a width and including a footbed; and a sole attached to the upper and including a heel portion, a lateral side and a medial side, said sole including a midsole having an upper surface and a lower surface, wherein said midsole includes a midsole sidewall with a medial end on the medial side of said sole and a lateral end on said lateral side of said sole, said midsole defining a recessed area and said upper surface of said midsole extending across the width of the upper, wherein said footbed is on said upper surface of said midsole, said sole forming a shell having a sidewall that extends from the lateral side around the heel portion to the medial side, said sidewall extending along the upper to a point above a top surface of the footbed, said sole including an outsole seated in said recessed area and attached to said midsole, said outsole having an outsole sidewall with a medial end on the medial side of said sole and a lateral end on said lateral side of said sole, wherein the medial ends of said outsole sidewall and said midsole sidewall are adjacent to each other and the lateral ends of said outsole sidewall and said midsole sidewall are adjacent to each other to form said sidewall of said shell.

2. The article of footwear of claim 1, wherein a height of the sidewall on said lateral side is greater than a height of the sidewall on said medial side.

3. The article of footwear of claim 1, wherein a height of the sidewall on said medial side is greater than a height of the sidewall on said lateral side.

4. The article of footwear of claim 1, wherein the difference of the hardness of said outsole and the hardness of said midsole is at least 10 Asker.

5. The article of footwear of claim 1, wherein the hardness of the midsole is 45 Asker and the hardness of the outsole is 55 Asker.

6. The article of footwear of claim 1, wherein said sidewall extends along a periphery of the medial side to the metatarsal head.

7. The article of footwear of claim 1, wherein said sole has a longitudinal axis and said outsole sidewall is asymmetrical relative to said longitudinal axis.

8. An article of footwear comprising:

an upper having a width and including a footbed; and a sole attached to the upper and including a heel portion, a lateral side and a medial side, said sole including a midsole having a midsole sidewall with a medial end on the medial side of said sole and a lateral end on said lateral side of said sole, an upper surface and a lower surface, said midsole including a recessed area and said upper surface extending across the width of the upper, wherein said footbed is on said upper surface of said sole, said sole forming a shell having a sidewall, said sidewall extending along the upper to a point above a top surface of the footbed, said sole including an outsole seated in said recessed area and attached to said midsole, said outsole having an outsole sidewall with a medial end on the medial side of said sole and a lateral end on said lateral side of said sole, wherein said outsole sidewall forms a portion of said sidewall of said shell, wherein the medial ends of said outsole sidewall and said midsole sidewall are adjacent to each other and the lateral ends of said outsole sidewall and said midsole sidewall are adjacent to each other to form said sidewall of said shell, and said sole including a first portion having a first hardness and a second portion having a second hardness, wherein said first hardness is different from said second hardness, and wherein said first portion extends along the lateral side about the heel portion and along at least part of the medial side.

9. The article of footwear of claim 8, wherein a height of the sidewall on said lateral side is greater than a height of the sidewall on said medial side.

10. The article of footwear of claim 8, wherein a height of the sidewall on said medial side is greater than a height of the sidewall on said lateral side.

11. The article of footwear of claim 8, wherein the difference of the hardness of said outsole and the hardness of said midsole is at least 10 Asker.

12. The article of footwear of claim 8, wherein the hardness of the midsole is 45 Asker and the hardness of the outsole is 55 Asker.

13. The article of footwear of claim 8, wherein said sidewall extends along a periphery of the medial side to the metatarsal head.

14. An article of footwear comprising:

an upper; and a sole attached to the upper and including a heel portion, a lateral side and a medial side, said sole including a midsole having a midsole sidewall with a medial end on the medial side of said sole and a lateral end on said lateral side of said sole, said midsole sidewall extending from the lateral side around the heel portion to the medial side, said midsole including a recessed area, said sole including an outsole seated in said recessed area and attached to said midsole, said outsole having an outsole sidewall with a medial end on the medial side of said sole and a lateral end on said lateral side of said sole, wherein the medial ends of said outsole sidewall and said midsole sidewall are adjacent to each other and the lateral ends of said outsole sidewall and said midsole sidewall are adjacent to each other to form a continuous sidewall of the sole.

15. The article of footwear of claim 14, wherein a height of the sidewall of the sole on said lateral side is greater than a height of the sidewall on said medial side.

16. The article of footwear of claim 14, wherein a height of the sidewall of the sole on said medial side is greater than a height of the sidewall on said lateral side.

17. The article of footwear of claim 14, wherein the difference of the hardness of said outsole and the hardness of said midsole is at least 10 Asker.

18. The article of footwear of claim 14, wherein the hardness of the midsole is 45 Asker and the hardness of the outsole is 55 Asker.

* * * * *